US008608353B2

(12) United States Patent
Girard

(10) Patent No.: US 8,608,353 B2
(45) Date of Patent: Dec. 17, 2013

(54) LIGHTING APPLIANCE

(76) Inventor: Nicolas Girard, Paris (FR)

( * ) Notice: Subject to any disclaimer, the term of this patent is extended or adjusted under 35 U.S.C. 154(b) by 207 days.

(21) Appl. No.: 13/175,336

(22) Filed: Jul. 1, 2011

(65) Prior Publication Data

US 2012/0014120 A1 Jan. 19, 2012

Related U.S. Application Data

(60) Provisional application No. 61/344,340, filed on Jul. 1, 2010.

(51) Int. Cl.
*F21V 21/096* (2006.01)
*F21V 21/14* (2006.01)

(52) U.S. Cl.
USPC ..... 362/398; 362/275; 362/285; 362/418; 362/430

(58) Field of Classification Search
USPC ..... 362/398, 275, 285, 287, 418, 419, 430; 248/206.5, 309.4; 439/38–40
See application file for complete search history.

(56) References Cited

U.S. PATENT DOCUMENTS

| | | | | | |
|---|---|---|---|---|---|
| 2,597,595 | A * | 5/1952 | Ordas | 362/271 |
| 2,695,950 | A * | 11/1954 | Zingone | 248/309.4 |
| 2,738,476 | A * | 3/1956 | Buquor | 439/160 |
| 5,515,246 | A * | 5/1996 | Maglica | 362/473 |
| 5,568,968 | A * | 10/1996 | Jaramillo | 362/376 |
| 6,877,880 | B2 * | 4/2005 | Endo | 362/282 |
| 6,951,409 | B2 * | 10/2005 | Hsien | 362/191 |

* cited by examiner

*Primary Examiner* — Alan Cariaso
(74) *Attorney, Agent, or Firm* — Edwards Wildman Palmer LLP; Peter C. Schechter; Christopher J. Capelli

(57) ABSTRACT

A lighting apparatus having a base support member defining an inner cavity portion and configured to have an outer multi-dimensional quadric surface. A mounting member is magnetically coupled to the base support member, the mounting member being configured and operative to be movable about an outer surface of the base support member. A lighting appliance is configured to mount a lighting element wherein the lighting appliance is magnetically coupled to the mounting member, the lighting appliance is further configured and operative to be movably positionable about the magnetic mount member.

18 Claims, 5 Drawing Sheets

LIGHTING APPLIANCE

FIELD OF THE INVENTION

The invention generally relates to lighting appliances, and more particularly, to a lighting appliance having a magnetic mounting apparatus providing uni-directional adjustment of the lighting appliance.

BACKGROUND OF THE INVENTION

Directional lighting appliances fixed to a wall, on a foot or mounted on rails are known. Typically, these appliances are for lighting fields of use which can change according to the direction in which the lighting appliance is pointed at and which is desirable, such as for lighting of shop fronts, art galleries, museums and performance stages.

A typical prior art lighting appliance is often swiveled by a ball joint or a universal joint. The spherical part of the joint is usually supported by the appliance itself, received in a bowl member in a shape corresponding with the support. The bowl member must house the spherical part sufficiently to hold it, which limits the opening angle of the swiveling cone. In these conditions, when lighting an area outside the scope of cone swiveling, it is often necessary to move the support to a different physical location. Only when a lighting appliance is mounted to a mobile stand is this possible, and is not possible when the lighting appliance is mounted to a wall appliance or a mounting mechanism fixed to a physical location.

Additionally, it is noted low voltage lighting appliances are often equipped with a cumbersome voltage converter that has to be moved with the support when the appliance is mounted on a foot type (mobile stand) support and has to be moved to change to a different physical location.

Thus, there is a need for a lighting device in which the lighting field of use can be adjusted, while not limiting the scope or angle of the lighting adjustment range while not necessitating the lighting device be moved to a different physical location.

SUMMARY OF THE INVENTION

In one aspect, a mounting apparatus for a lighting appliance is described in which an aspect of the invention provides a lighting mounting apparatus that essentially consists of a revolving body the surface of which is a quadric on which a lighting appliance magnetically mounts to. It is to be understood a feature of the invention is it provides a support for lighting appliances enabling larger lighting coverage areas without having to change the physical location of the lighting appliance.

In an illustrated embodiment, the invention includes a lighting appliance support member comprising an outer revolving body whose surface is preferably a quadric on which at least one lighting appliance is magnetically coupled thereto. The magnet with which a lighting appliance is coupled to preferably includes first and second magnetic concave contact areas in which a first magnetic concave contact area is configured and operative to be in movable contact on the outer surface of the revolving body, which preferably forms the base of the lighting appliance. The second magnetic concave contact area is configured and operative to be in movable contact with a lighting appliance having the illuminating member (e.g., the bulb). The lighting appliance is thus designed to move in multiple directions via a magnetic disk placed between the bulb support and the base. According to one exemplary embodiment, the revolving bodies of the base and lighting appliance bulb support are a sphere or similar configuration, but are not to be understood to be limited thereto.

These and other features of the lighting device of the subject invention will become more readily apparent to those having ordinary skill in the art from the following detailed description of the invention taken in conjunction with the several drawings figures in accordance with an illustrated embodiment of the invention.

BRIEF DESCRIPTION OF THE DRAWINGS

The objects and features of the invention can be understood with reference to the following detailed description of an illustrative embodiment of the present invention taken together in conjunction with the accompanying drawings in which.

WRITTEN DESCRIPTION OF CERTAIN EMBODIMENTS OF THE INVENTION

The present invention is now described more fully with reference to the accompanying drawings, in which an illustrated embodiment of the present invention is shown. The present invention is not limited in any way to the illustrated embodiments as the illustrated embodiments described below are merely exemplary of the invention, which can be embodied in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the present invention. Furthermore, the terms and phrases used herein are not intended to be limiting but rather to provide an understandable description of the invention.

Figure 1:
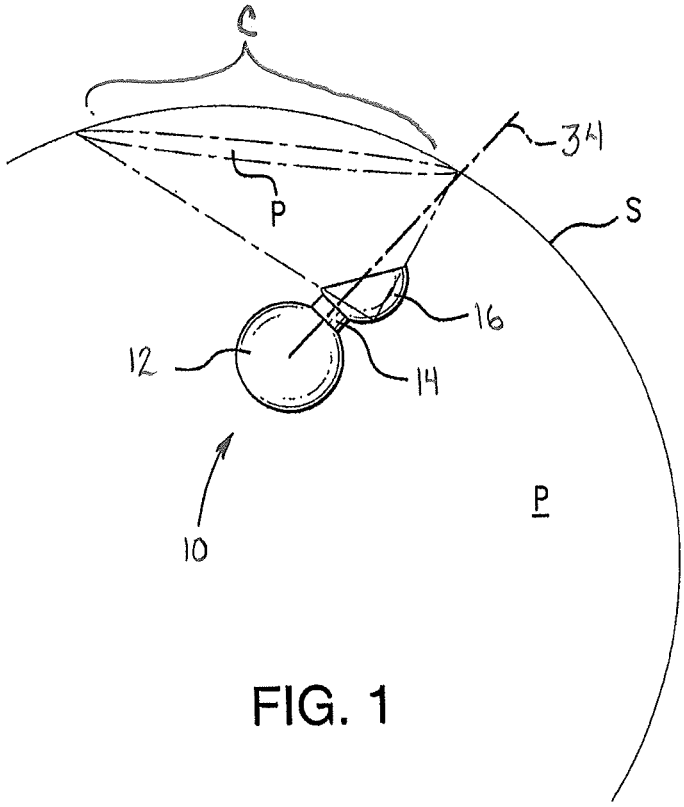
FIG. 1 is an overhead view of a lighting device in accordance with an illustrated embodiment of the invention depicting the different positions capable of a magnetically coupled lighting appliance.

With reference now to FIG. 1, and in accordance with an illustrated embodiment, the present invention relates to a lighting device, referenced generally by numeral 10. Lighting device 10 generally includes a support member 12, a magnetic mount member 14 and a lighting appliance 16. As described in further detail below, support member 12 preferably magnetically couples to magnetic mount member 14, with magnetic mount member 14 also magnetically coupling to the lighting appliance 16. The lighting device 10 is configured and operative to provide uni-directional positioning of lighting appliance 16 relative to the magnetically coupled support member 12.

Figure 2:
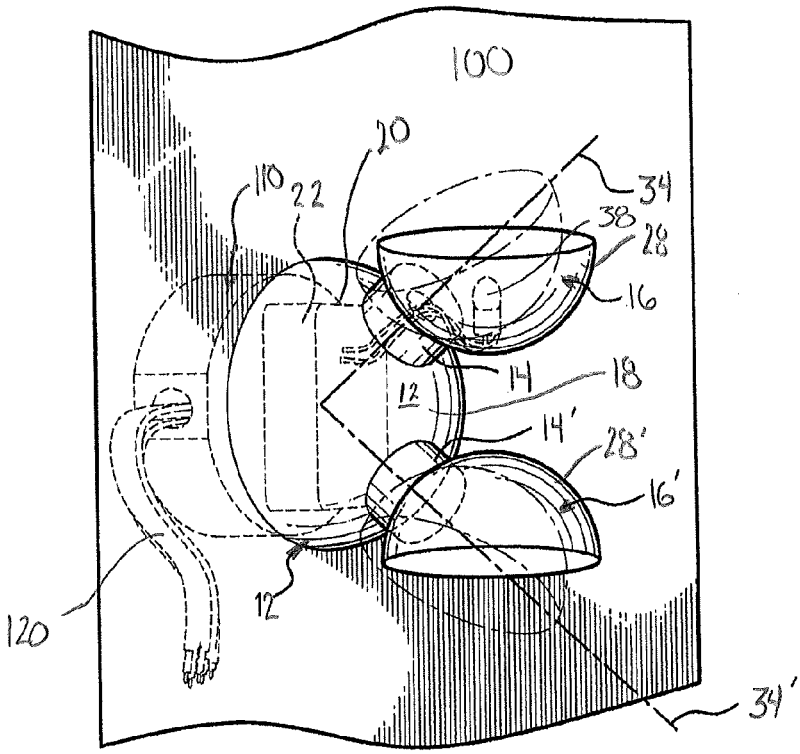
FIG. 2 is an perspective view of a lighting device in accordance with another illustrated embodiment of the invention depicting the different positions capable of a multiple magnetically coupled lighting appliances.

With reference now to FIGS. 1 and 2, support member 12 is preferably configured to have an outer multi-dimensional quadric surface 18, such as spherical or semi-spherical configuration (but not to be understood to be limited thereto as it is to be understood it may encompass any oblong quadric suitable for a particular application for lighting device 10). Support member 12 may be formed of any material suitable for enabling magnetic coupling to magnetic mount member 14. Support member 12 preferably defines an inner cavity portion 20 which may be configured and operative to house power supply means 22 (e.g., a battery, voltage converter, etc.) for the lighting apparatus 10, which inner cavity portion 20 is preferably hidden, and does not impair the aesthetic of the whole of support member 12, moreover, such support member 12 can support multiple lighting appliances 16' magnetically attached to a common support member 12.

Figure 5:
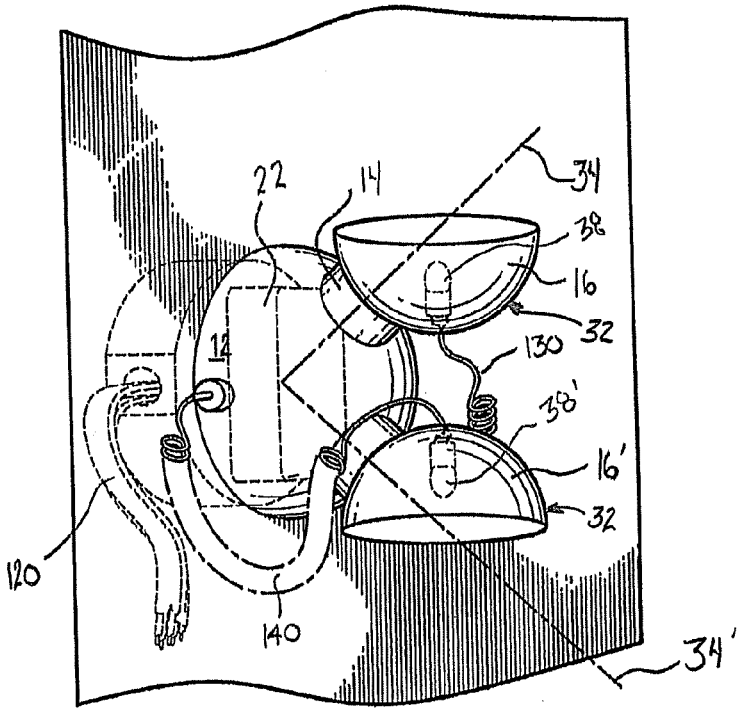
FIG. 5 is a perspective view of a lighting device in accordance with the illustrated embodiment of FIG. 2 depicting electrical connections to each lighting appliance.

Additionally support member 12 may include fixation means for enabling fixation to a fixed surface 100 (e.g., a wall, ceiling, ground, or any support capable of supporting lighting device 10) via a conventional mounting box or other suitable means 110. As shown in FIG. 2, an electrical power supply (via wire 120) is supplied to mounting box 110, which in turn couples to power means 22. The power means/supply 22 may connect to each lighting appliance 16 and 16' through any known means. For instance, as shown in the illustrated embodiment of FIG. 5, each lighting appliance 16 and 16' is electrical coupled to one another in serial fashion, via wire 130, wherein one of the lighting appliances 16' is directly coupled to power means 22 via coupling wire 140.

Figure 3:
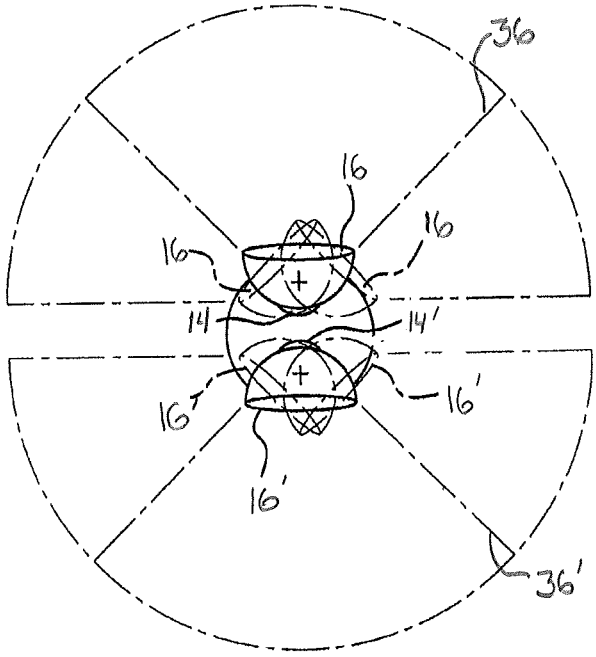
FIG. 3 is an overhead view of a lighting device in accordance with the illustrated embodiment of FIG. 2.
Figure 6:
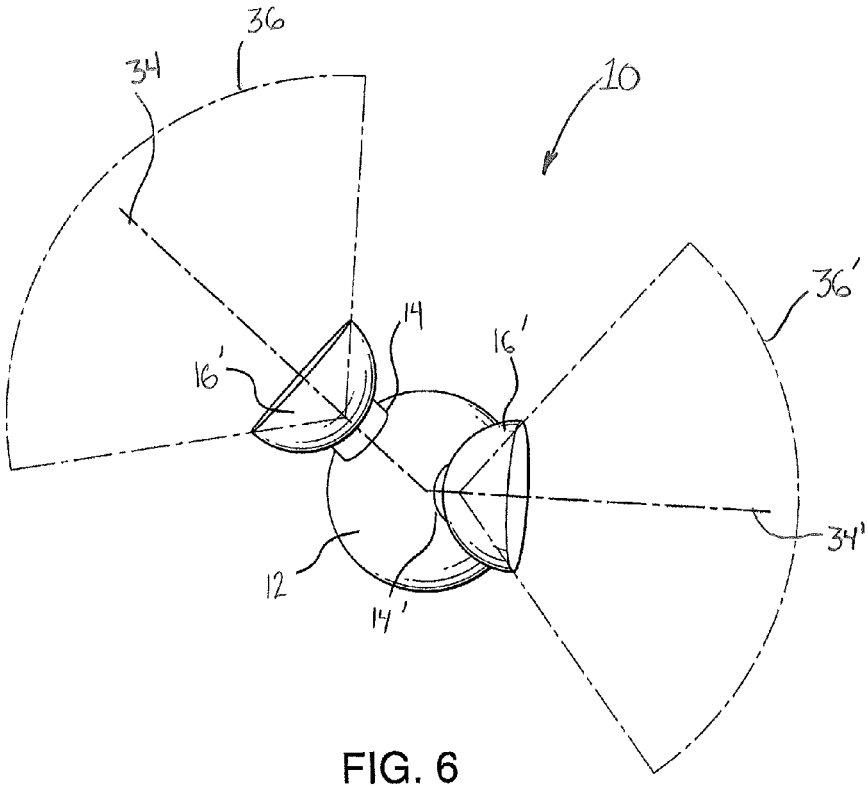
FIG. 6 is a perspective view of a lighting device in accordance with the illustrated embodiment of FIG. 2 depicting the illumination coverage areas for each lighting appliance.

With reference to FIGS. 3 and 6, it is to be understood and appreciated when a support member 12 supports multiple lighting appliances 16 and 16', each aforesaid lighting appliance 16 and 16' may be positioned independent of one another on its respective magnetic mount member 14 and 14' so as to provide an adjustable respective light beam projection 36 and 36'. It is to be further appreciated and understood that while the illustrated embodiments (e.g., FIGS. 2, 3, 5 and 6) depict first and second lighting appliances 16 and 16' magnetically mounted to a common support member 12, the invention is not to be understood to be limited to only first and second lighting appliances 16 and 16' but rather may encompass any multitude of lighting appliances 16 mounted to a common support member 12.

Figure 4:
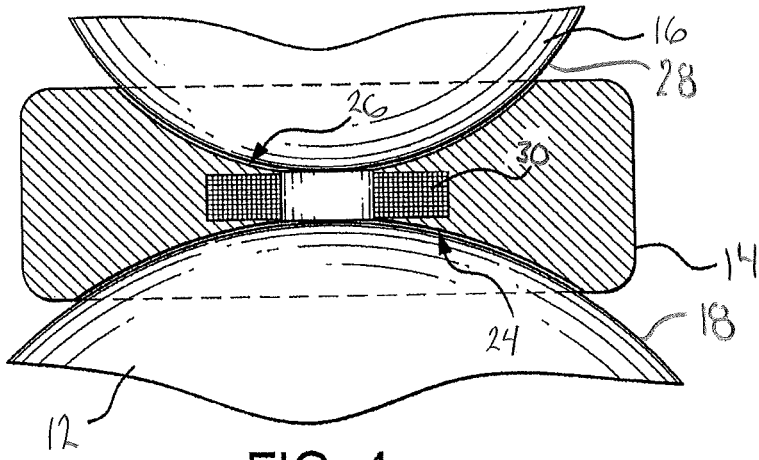
FIG. 4 is a cross-sectional view of a magnet mounting member depicted in the various illustrated embodiments of the invention.

With regards to magnetic mount member 14 (and with reference to FIG. 4), it is configured and operative to magnetically couple to both the support member 12 and a lighting appliance 16. Magnetic mount member 14 is formed to have a first portion (e.g., concave) 24 configured to couple to the outer surface 18 of the support member 12 and a second portion (e.g., concave) 26 configured to couple to an outer surface portion 28 of a lighting appliance 16. A magnetic member 30 is preferably positioned in the body portion of the magnetic mount member 14 intermediate the aforesaid first and second portions 24, 26 so as to enable magnetic coupling of the magnetic member 30 to both the support member 12 and lighting appliance 16. Alternatively, magnetic mount member 14 may be formed with a magnetic material enabling the aforesaid magnetic coupling. Further, it is to be understood and appreciated the magnet 30 may be of any kind, permanent or electro-magnetic and the number of lighting appliances 16 that may be magnetically coupled thereto can be single or multiple (as also mentioned above).

And with regards to lighting appliance 16, it includes a body portion 32 configured and operative to house lighting structure for supporting a lighting element 38 (e.g., a light bulb, fluorescent lamp, or any other means for illuminating light). Body portion 32 of lighting appliance 16 is configured to preferably conform to the second mounting portion 26 defined in the magnetic mount member 14 for movement therewith. As shown in the illustrated embodiments of FIGS. 1-6, the body portion 32 of lighting appliance 16 is configured to have a semi-spherical configuration adapted to receive within the concave portion defined in the second mounting portion 26 of the magnetic mount member 14.

In accordance with the illustrated embodiments of FIGS. 1-6, wherein support member 12 has a hemispherical or quasi spherical outer surface portion 18, the lighting appliance 16 is operative to move (e.g., pivot) on the magnet mount member 14 in all points following a quadric, while the magnet mount member 14 and lighting appliance 16 combination can itself move in all points on the spherical outer surface 18 of the support member 12 thus enabling revolution without obstacles.

Therefore, it is to be understood and appreciated the lighting appliance 16 can illuminate an area P within the limit of a circular pattern C for a position given on the outer surface 18 of the support member 12 (FIG. 1). The aforesaid circular pattern C is determined by the different positions that the lighting appliance 16 can take on the axis 34 extending from the support member 12. It is to be understood the axis 34 corresponds with any point of the outer surface 18 of the support member 12, which allows the circle C to define all possible positions in relation to a virtual sphere of the same center as the support member 12.

With specific reference to FIG. 1, the light beam 36 of the lighting appliance 16 has been represented inclined in relation to the field of use P but it is to be understood and appreciated the effect can be cancelled by the combined choice of the position of the lighting appliance 16 on the magnet mount member 14 and the position of the lighting appliance 16 and magnet mount member 14 on the support member 12. It is to be further understood and appreciated this combined choice of the two positions makes it possible to adjust the lighting appliance 16 to illuminate any desired object situated around the support member 12 without there being any need to move the support member 12 to a different physical location.

Additionally, it is to be understood and appreciated the support member 12 and/or magnetic mount member 14 can be mounted on a footing surface (e.g., ground, floor, etc.), suspended on a rod, or fixed to a supply system by a removable or fixed rail mounted to a wall or ceiling.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

The above presents a description of a best mode contemplated for carrying out the present invention lighting appliance, and of the manner and process of making and using it, in such full, clear, concise, and exact terms as to enable any person skilled in the art to which it pertains to make and use these devices. The present invention lighting appliance is, however, susceptible to modifications and alternative method steps from those discussed above that are fully equivalent. Consequently, the present invention lighting appliance is not limited to the particular embodiments disclosed. On the contrary, the present invention lighting appliance encompasses all modifications and alternative constructions and methods coming within the spirit and scope of the present invention.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A unidirectional lighting apparatus comprising:

a base support member defined by an outer surface portion;

a mount member magnetically coupled to the base support member, the mount member including first and second mounting portions wherein the first mounting portion is configured to conform to the other surface portion of the support member; and a lighting appliance defined by an outer surface portion, the lighting appliance configured to mount a lighting element wherein the lighting appliance is magnetically coupled to the mount member wherein the second mounting portion of the mount member is configured to conform to the outer surface portion of the lighting appliance.

2. A unidirectional lighting apparatus as recited in claim 1 wherein the mount member is configured and operative to be movable about an outer surface of the base support member.

3. A unidirectional lighting apparatus as recited in claim 1 wherein the lighting appliance is configured and operative to be movably positionable about the magnetic mount member.

4. A unidirectional lighting apparatus as recited in claim 1 wherein the support member is configured to have an outer multi-dimensional quadric surface.

5. A unidirectional lighting apparatus as recited in claim 4 wherein the outer multi-dimensional quadric surface of the support member has a spherical configuration.

6. A unidirectional lighting apparatus as recited in claim 1 wherein the support member defines an inner cavity portion.

7. A unidirectional lighting apparatus as recited in claim 6 wherein the inner cavity portion is configured to contain a power supply for the lighting appliance.

8. A unidirectional lighting apparatus as recited in claim 1 wherein each of the first and second mounting portions is defined by a concave cavity.

9. A unidirectional lighting apparatus as recited in claim 1 wherein the magnetic mount member includes a magnetic member.

10. A unidirectional lighting apparatus as recited in claim 9 wherein the magnetic member is positioned intermediate the first and second mounting portions.

11. A unidirectional lighting apparatus as recited in claim 1 wherein the lighting appliance is configured to have an outer multi-dimensional quadric surface.

12. A unidirectional lighting apparatus as recited in claim 11 wherein the outer multi-dimensional quadric surface of the lighting appliance has a spherical configuration.

13. A unidirectional lighting apparatus as recited in claim 12 wherein the outer multi-dimensional quadric surface of the lighting appliance has a semi-spherical configuration.

14. A lighting apparatus comprising:

a base support member defining an inner cavity portion and configured to have an outer multi-dimensional quadric surface;

a mount member magnetically coupled to the base support member, the mount member being configured and operative to be movable about the outer multi-dimensional quadric surface of the base support member; and a lighting appliance configured to mount a lighting element wherein the lighting appliance is magnetically coupled to the mount member, the lighting appliance is further configured and operative to be movably positionable about the magnetic mount member, the lighting appliance is further configured to have an outer multi-dimensional quadric surface wherein the magnetic mount member includes first and second mounting portions wherein the first mounting portion is configured to conform to the other multi-dimensional quadric surface portion of the support member and the second mounting portion is configured to conform to the outer multi-dimensional quadric surface portion of the lighting appliance.

15. A unidirectional lighting apparatus as recited in claim 14 wherein the inner cavity portion is configured to contain a power supply for the lighting appliance.

16. A unidirectional lighting apparatus as recited in claim 14 wherein each of the first and second mounting portions is defined by a concave cavity.

17. A unidirectional lighting apparatus as recited in claim 16 wherein the magnetic mount member includes a magnetic member.

18. A unidirectional lighting apparatus as recited in claim 17 wherein the magnetic member is positioned intermediate the first and second mounting portions.

* * * * *